US006604975B1

(12) United States Patent
Yeh

(10) Patent No.: US 6,604,975 B1
(45) Date of Patent: Aug. 12, 2003

(54) DOLL HEAD MASK

(76) Inventor: Chia-Ching Yeh, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/133,254

(22) Filed: Apr. 29, 2002

(51) Int. Cl.[7] ..... A42B 7/00; A63H 33/00

(52) U.S. Cl. ..... 446/27; 446/486; 2/9; 2/206

(58) Field of Search ..... 2/173, 206, 9; 446/26, 27, 486, 391, 394; 472/133

(56) References Cited

U.S. PATENT DOCUMENTS 2,262,992 A * 11/1941 Dessart ..... 2/206
3,129,001 A * 4/1964 Winchell ..... 2/206
4,729,747 A * 3/1988 Yeh ..... 446/27
5,617,584 A * 4/1997 Brennan ..... 2/172
6,505,351 B2 * 1/2003 Yeh ..... 2/206

* cited by examiner

*Primary Examiner*—Jacob K. Ackun

(57) ABSTRACT

A doll head mask comprises a hair ring; the hair ring being a cambered rubber ring; and a doll mask for shielding a face of a user wearing the doll mask and being connected to a hair ring. After the doll mask is mounted to the hair ring, the hair ring can be worn upon the head of the user for covering the face of the user. Two sides of the doll mask are extended with respective connecting pieces, and a distal end of each connecting piece is pivotally connected to the hair ring. The lower portion of the doll mask is a movable jaw. The movable jaw has two pivotal shafts; one of the pivotal shafts is connected to the doll mask and the other one is embedded into a cambered groove in the doll mask. Moreover, the doll mask is formed by a plurality of small elements.

4 Claims, 4 Drawing Sheets

DOLL HEAD MASK

FIELD OF THE INVENTION

The present invention relates to doll masks, and particularly to doll head mask which have many movable parts so as to present a vivid effect.

BACKGROUND OF THE INVENTION

The decorating masks worn by children have in generally two sides which are tied with respective elastic cords. The defect of this design is that the elastic cords are too tight to be worn comfortably. Moreover, the mask will make some difficulties to the breathing or viewing of the user.

In order to avoid this problem, a decoration with a simple structure is disclosed by the applicant of the present invention. In that, a hair ring is utilized to be mounted to a doll mask. However, some other patents disclosed mask with shielding effect, such as those disclosed in U.S. Pat. No. 2,262,992, "Masquerade, Carnival, or Party Mask" and U.S. Pat. No. 4,729,747, "Head-mounted Double Motor-driven". Moreover, some patents disclose hair rings which have other fittings, such as U.S. Pat. No. 4,729,747, "Head-mounted Double Motor-driven" However, above mentioned patents can not achieve the object of being worn comfortably for a longer time and shielding the face. Thereby, they are necessary to be improved.

SUMMARY OF THE INVENTION

Accordingly, the primary object of the present invention is to provide a doll head mask, which may improve the defects in the prior art.

To achieve above objects, the present invention provides a doll head mask comprising a hair ring; the hair ring being a cambered rubber ring; and a doll mask for shielding a face of a user wearing the doll mask and being connected to a hair ring. After the doll mask is mounted to the hair ring, the hair ring is worn upon the head of the user for covering the face of the user. Two sides of the doll mask are extended with respective connecting pieces, and a distal end of each connecting piece is pivotal connected to the hair ring. The lower portion of the doll mask is a movable jaw. The movable jaw has two pivotal shafts; one of the pivotal shafts is connected to the doll mask and the other one is embedded into a cambered groove in the doll mask. Moreover, the doll mask is formed by a plurality of small elements.

The various objects and advantages of the present invention will be more readily understood from the following detailed description when read in conjunction with the appended drawing.

DETAILED DESCRIPTION OF THE PREFERRED EMBODIMENTS

Figure 1:
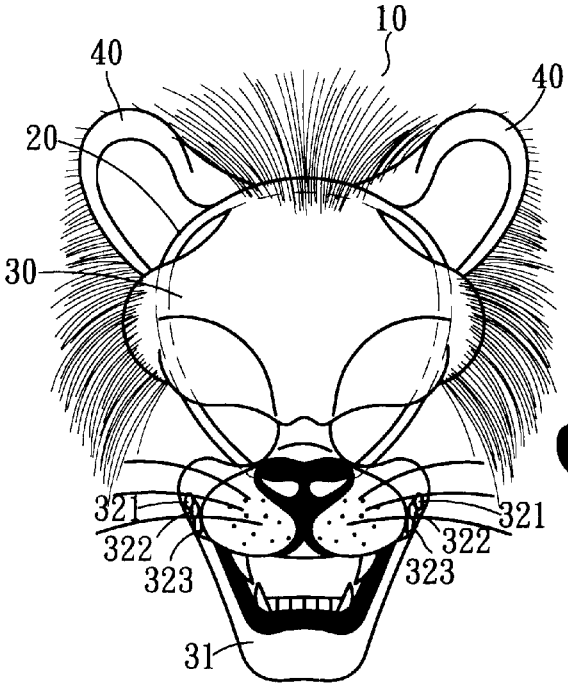
FIG. 1 is a front view of the doll head mask in the first embodiment of the present invention.
Figure 2:
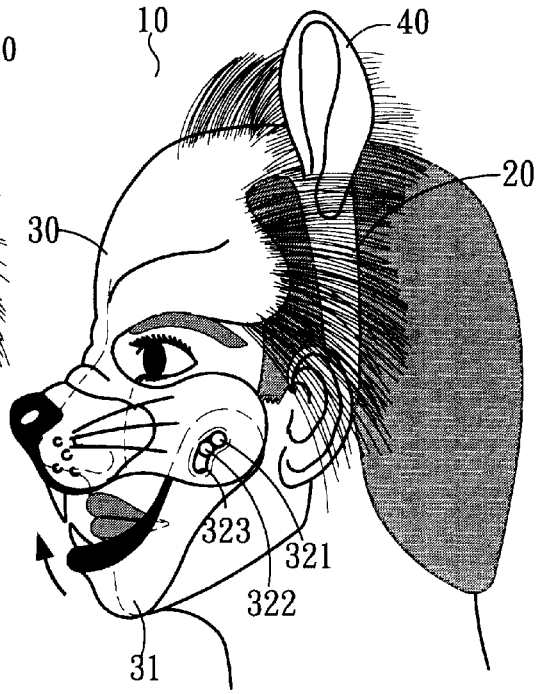
FIG. 2 is a lateral view of the doll head mask of FIG. 1.

Referring to FIG. 1, the preferred embodiment of the present invention is illustrated, wherein a front view of a doll head mask is illustrated, and FIG. 2 shows a lateral view of FIG. 1. The doll head mask 10 is formed by a hair ring 20 and a thin plastic doll mask 30. The hair ring 20 and doll mask 30 can be combined by gluing, thermally welding, thermally gluing, taping, buckling, etc. The inner and outer surfaces of the two are painted, or coated with a surface layer which can be a cloth or a plastic film. Moreover, some fittings 10 can be used as decorations of the doll head mask 10, such as ears 40, hair, beard, long teeth, etc.

Figure 3:
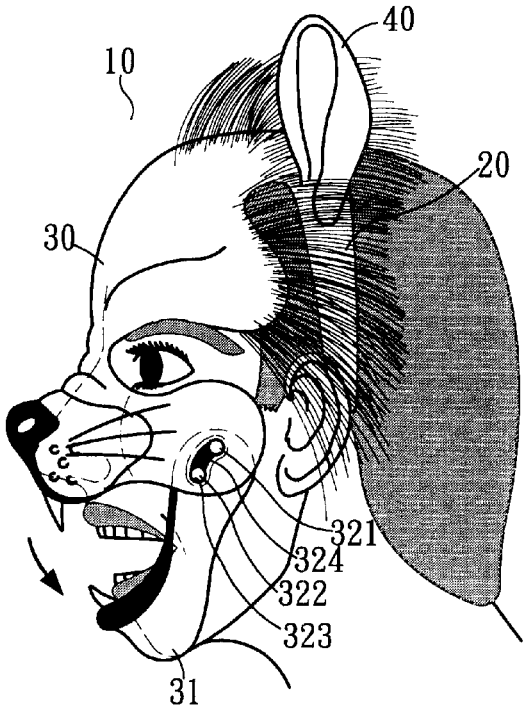
FIG. 3 shows an action of the doll head mask of FIG. 2.

To make the doll mask 30 vivid, the doll mask 30 can be divided into an upper section and a lower section. The lower section can be made as a movable jaw 31. The movable jaw 31 has two pivotal shafts 321, and 322. One pivotal shaft 321 is mounted to the body of the doll mask 30, and another pivotal shaft 322 is embedded into a cambered groove 322 of the doll mask 30. A small spring 324 (referring to FIG. 3) is used to connect the two doll masks 30. Thereby, when the jaw of the user wearing the doll mask 30 opens, the movable jaw 31 will descend. Then, the pivotal shaft 322 moves with the movable jaw 31 so as to rotate from the upper side of a cambered groove 323 to the lower side. When the jaw of the user closes, the movable jaw 31 will restore due to the compressing of the small spring 324.

Figure 4:
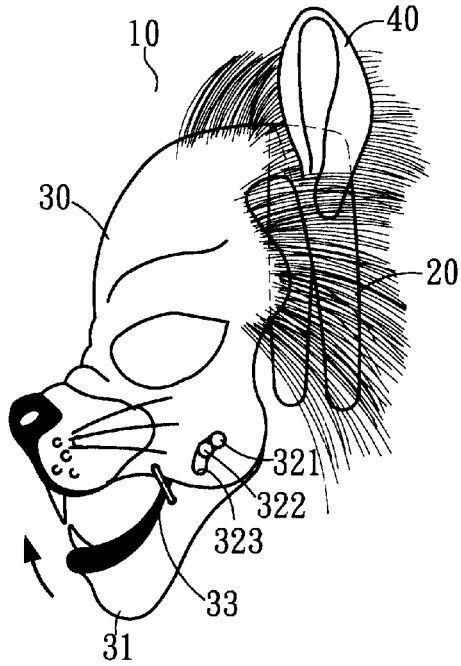
FIG. 4 is a lateral view of the doll head mask in the second embodiment of the present invention.
Figure 5:
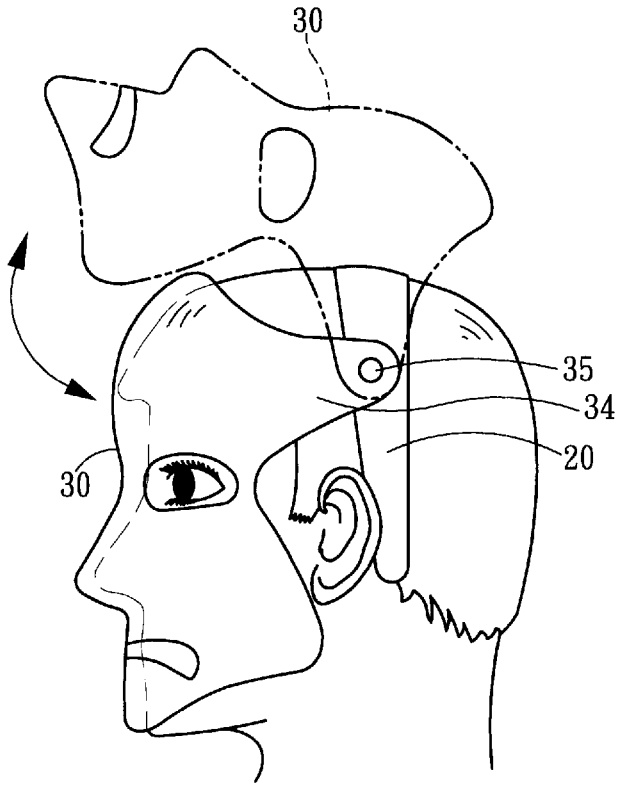
FIG. 5 is a lateral view of the doll head mask in the third embodiment of the present invention.

With reference to FIG. 4, the second of the present invention is illustrated in the drawing. A doll mask is illustrated in FIG. 4, which is identical to that disclosed in FIG. 1, while no small spring 324 is used to connected the two pivotal shafts 321, and 322. In this the present invention, an elastic strip 33 is installed at a mouth portion between the doll mask 30 and the movable jaw 31 so that the movable jaw 31 can restore by the elastic strip 33. In the U.S. Pat. No 3,089,148, a movable jaw is disclosed, while no element, such as spring, elastic strip, is disclosed and thus no function of automatically restoring. Thereby, the movable jaw of the present invention has a preferred design Referring to FIG. 5, the third embodiment of the present invention is illustrated. In this embodiment, two sides of the doll mask 30 are extended with two connecting pieces 34. A distal end of each connecting piece 34 has a pivotal shaft 341 for being connected to the hair ring 20. Thereby, the doll mask 30 can be used to cover the face of the user and can be opened as desired. The operations of opening and covering are easy and convenient.

Figure 6:
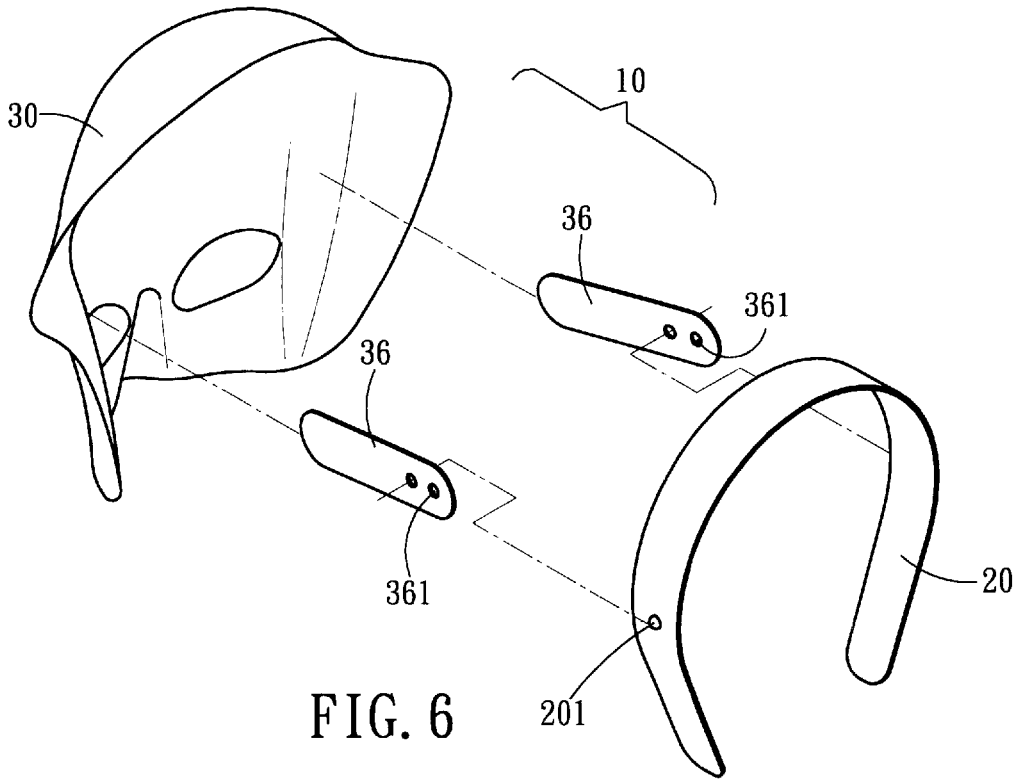
FIG. 6 is an exploded perspective view of the doll head mask in the fourth embodiment of the present invention.
Figure 7:
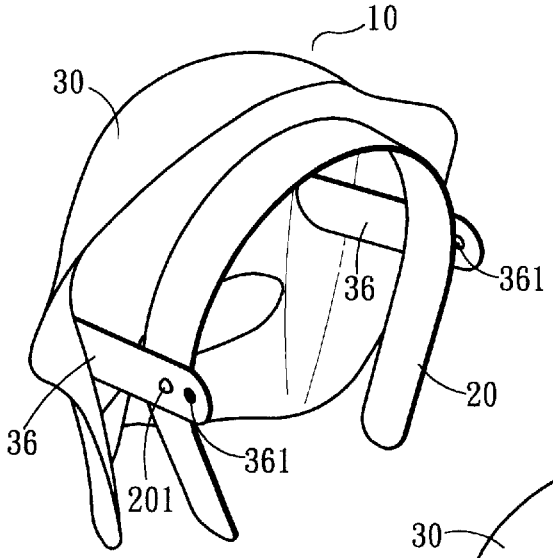
FIG. 7 is an assembled view of the doll head mask of FIG. 6.
Figure 8:
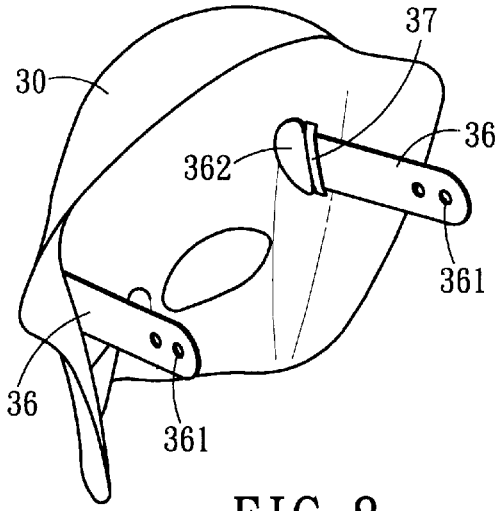
FIG. 8 is a partial assembled view of the doll head mask in FIG. 6.
Figure 9:
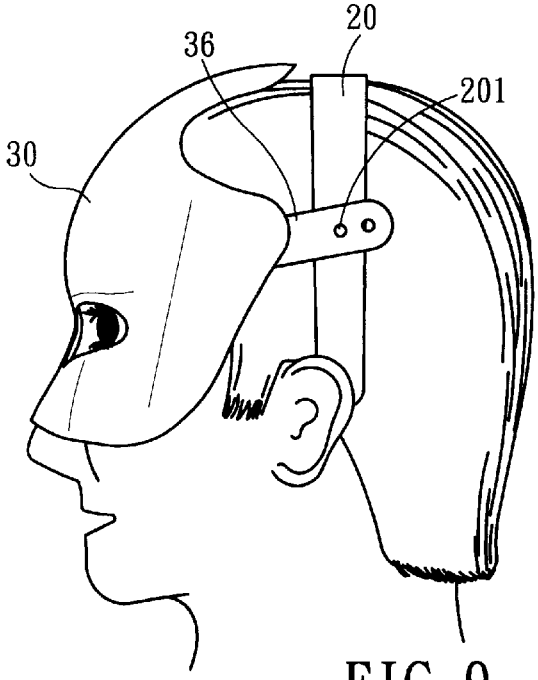
FIG. 9 shows one application of the doll head mask illustrated in FIG. 6.

Referring to FIG. 6, the fourth embodiment of the present invention is illustrated. In this embodiment, the connecting pieces 36 at two sides of the doll mask 30 are independent. One end of the connecting piece 36 is fixed to the inner wall of the doll mask 30 by gluing, thermally welding, thermally gluing, taping, buckling, etc., while another thereof is connected to the button 201 of the hair ring 20 through a bank of holes 361 (see FIG. 7). Thereby, the lengths of the connecting pieces 36 are adjustable for suiting the size of the head of the user. Besides, as shown in FIG. 8, one end of the connecting piece 36 is made as a hook 362 so that after the connecting piece 36 passes through the buckle 37 in the inner wall of the doll mask 30, and then it is pivotally connected to the hair ring 20. The use thereof is illustrated in FIG. 9.

Figure 10:
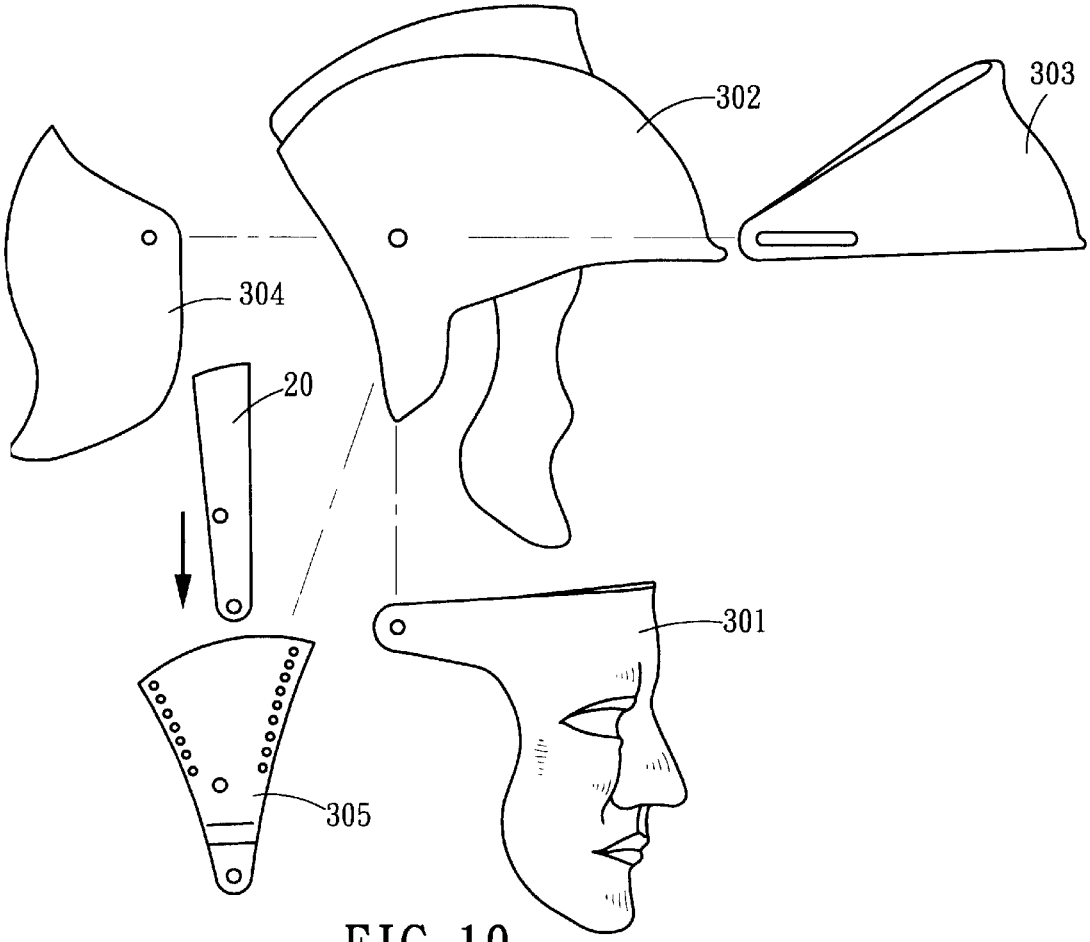
FIG. 10 is an exploded view showing the doll head mask of the fifth embodiment of the present invention.
Figure 11:
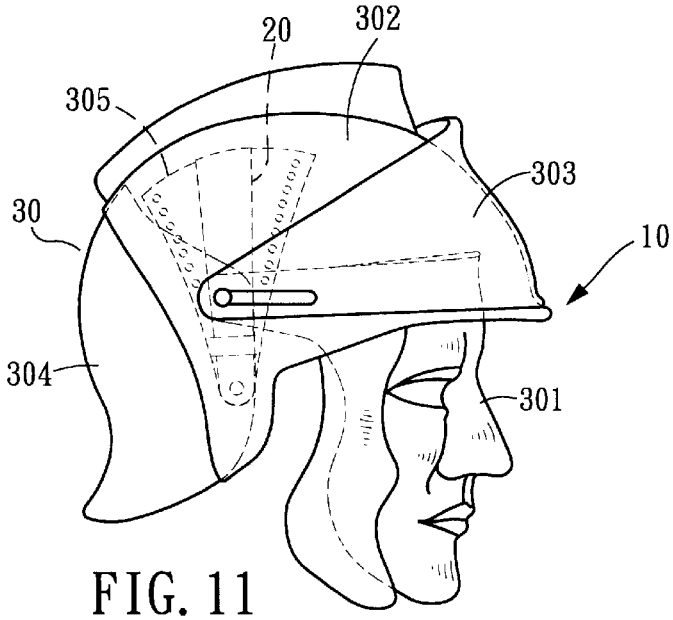
FIG. 11 is an assembled view of the doll head mask illustrated in FIG. 10.

With reference to FIGS. 10 and 11, in above mentioned example, the hair ring 20 is mounted to a single doll mask 30, but in this embodiment, the doll mask 30 can be formed a plurality of pieces and then the doll mask 30 is mounted with the hair ring 20. FIGS. 10 and 11 shows the exploded perspective view and assembled perspective view of the doll mask of the present invention. The doll mask 30 is formed by five pieces 301 to 305 and then the doll mask 30 is assembled with the hair ring 20. In the doll mask 30, the face portion 301 and the hamlet 302 are fixed. The front portion 303 and rear portion 304 are movable. The protecting ring 305 is connected to the hair ring 20 and then they are worn to the head of the user. Thereby, it is known that the doll mask 30 can be formed by a plurality of pieces.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A doll head mask comprising:

a hair ring; the hair ring being a rubber ring; and a doll mask for shielding a face of a user wearing the doll mask and being connected to a hair ring;

whereby after the doll mask is mounted to the hair ring, the hair ring is capable of being worn upon the head of the user for covering the face of the user;

wherein two sides of the doll mask are connected to the hair ring through independent connecting pieces; one end of each connecting piece is connected to the doll mask, and another end of each connecting piece has a bank of holes for being buckled by a button on the hair ring.

2. The doll head mask as claimed in claim 1, wherein two sides of the doll mask are extended with respective connecting pieces, and a distal end of each connecting piece is pivotally connected to the hair ring.

3. The doll head mask as claimed in claim 1, wherein the doll mask has an upper portion and a lower portion, the lower portion is a movable jaw; the movable jaw has two pivotal shafts; one of the pivotal shafts is connected to the doll mask and the other one is embedded into a groove in the doll mask; and a spring is used to connect the two pivotal shafts.

4. The doll head mask as claimed in claim 1, wherein the doll mask has an upper portion and a lower portion, the lower portion is a movable jaw; the movable jaw has two pivotal shafts; one of the pivotal shafts is connected to the doll mask and the other one is embedded into a groove in the doll mask; and a spring strip is used to connect the doll mask and the movable jaw.

* * * * *